United States Patent [19]

Sollander et al.

[11] Patent Number: 4,732,181

[45] Date of Patent: Mar. 22, 1988

[54] VEHICLE CARRIED SYSTEM FOR CAMOUFLAGE WITH FOAM

[76] Inventors: Stefan Sollander, 1892 Berge, S-834 00 Brunflo; Rainer Trübenbach, Schiringe Gard, S-642 00 Flen; Per Wigren, Pl 3386A, S-635 90 Eskilstuna, all of Sweden

[21] Appl. No.: 831,985

[22] Filed: Feb. 21, 1986

[30] Foreign Application Priority Data

Feb. 22, 1985 [SE] Sweden ..... 8500875

[51] Int. Cl.[4] ..... B65B 3/04

[52] U.S. Cl. ..... 141/98; 141/100; 141/114; 141/231; 89/36.01; 428/919; 261/DIG. 26; 239/428.5; 169/15; 425/4 R

[58] Field of Search ..... 89/36.01, 36.08; 239/428.5; 141/98, 100, 231, 10, 114; 169/14, 15, 44; 280/770; 206/523, 524; 106/14.05; 521/917; 425/4 R; 261/DIG. 26; 264/45.2, 50; 252/350, 307; 428/919

[56] References Cited

U.S. PATENT DOCUMENTS

| | | | |
|---|---|---|---|
| 2,597,913 | 5/1952 | Webster | 261/116 |
| 2,936,835 | 5/1960 | Sheppard | 261/DIG. 26 |
| 3,164,374 | 1/1965 | Ralph | 261/DIG. 26 |
| 3,186,490 | 6/1965 | Jamison | 169/15 |
| 3,420,310 | 1/1969 | Mears et al. | 169/15 |
| 3,441,086 | 4/1969 | Barnes | 169/15 |
| 3,465,827 | 9/1969 | Levy et al. | 261/DIG. 26 |
| 3,547,200 | 12/1970 | Hout | 169/15 |
| 3,620,306 | 10/1971 | Shepherd | 169/15 |
| 3,780,812 | 12/1973 | Lambert | 169/15 |
| 4,037,664 | 7/1977 | Gibson | 169/15 |
| 4,137,048 | 1/1979 | Steinman | 261/DIG. 26 |
| 4,142,015 | 2/1979 | Bienz | 89/36.08 X |
| 4,156,033 | 5/1979 | Bienz | 89/36.08 X |
| 4,291,769 | 9/1981 | Müller | 169/24 X |
| 4,390,333 | 6/1983 | Dubois | 141/10 X |
| 4,400,220 | 8/1983 | Cole, Jr. | 261/DIG. 26 |
| 4,474,680 | 10/1984 | Kroll | 261/DIG. 26 |
| 4,517,230 | 5/1985 | Crawford | 428/919 |

FOREIGN PATENT DOCUMENTS

| | | | |
|---|---|---|---|
| 0221878 | 1/1957 | Austria | 239/428.5 |
| 0018956 | 11/1980 | European Pat. Off. . | |
| 3217977 | 11/1983 | Fed. Rep. of Germany . | |
| 1131158 | 5/1954 | France . | |
| 2521715 | 8/1983 | France . | |
| 2562231 | 10/1985 | France | 89/36.01 |
| 80030554 | 4/1980 | Sweden . | |
| 0842461 | 7/1960 | United Kingdom | 239/428.5 |
| 1266052 | 3/1972 | United Kingdom | 261/DIG. 26 |

*Primary Examiner*—Henry J. Recla
*Assistant Examiner*—Ernest G. Cusick
*Attorney, Agent, or Firm*—Limbach, Limbach & Sutton

[57] ABSTRACT

A vehicle carried system for camouflage with foam includes a plant for generating water-based foam. The foam generating plant includes a reservoir for foaming liquid or a water tank with a reservoir for a foaming agent, which are connected to produce foaming liquid. The foaming liquid is pumped, or delivered in another way, under pressure to the foam generator for generating camouflage to be applied to the ground or to be filled into containers. Containers and free foam are preferably colored to give the protected object a good visual camouflage.

5 Claims, 7 Drawing Figures

Fig. 1
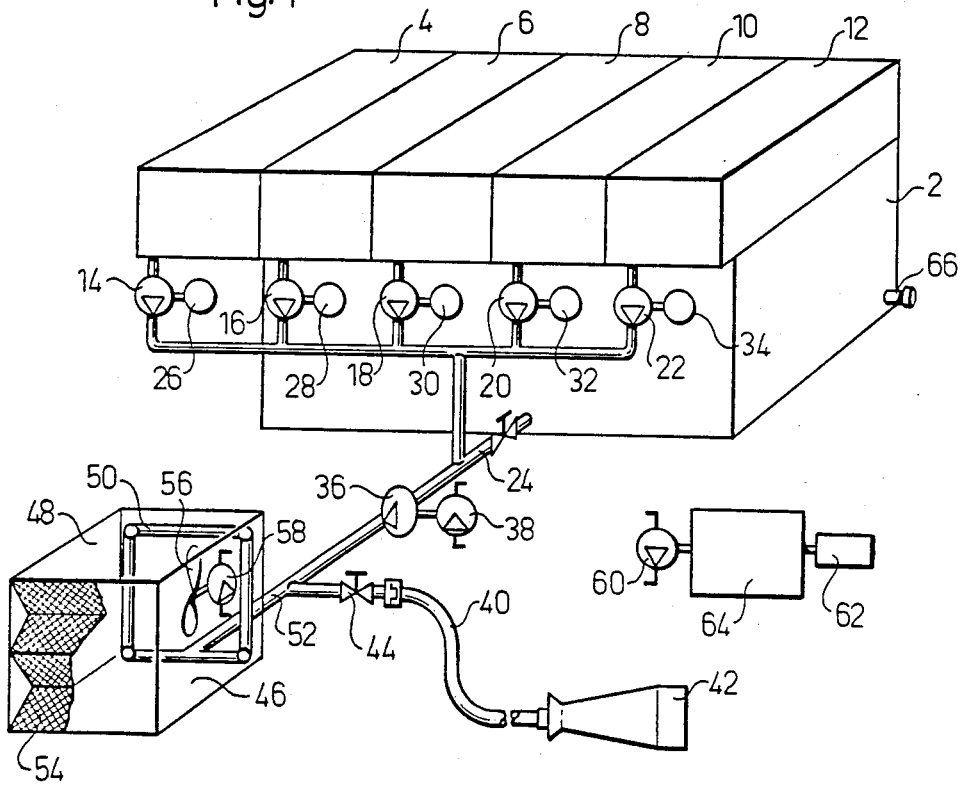
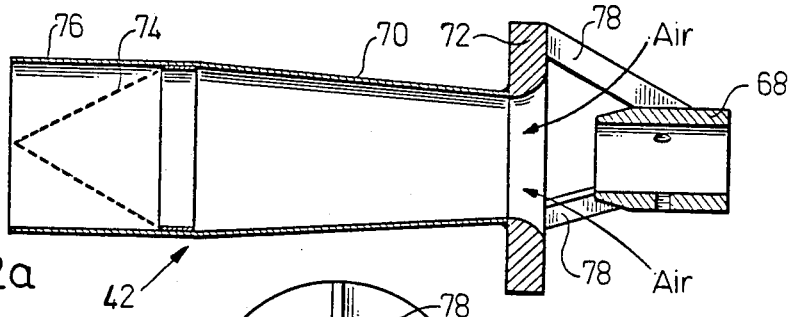
Fig. 2a
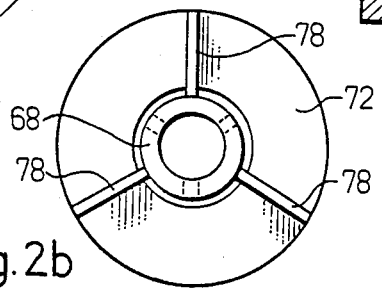
Fig. 2b

VEHICLE CARRIED SYSTEM FOR CAMOUFLAGE WITH FOAM

TECHNICAL FIELD

The present invention relates to a vehicle carried system for camouflage with foam including a plant for generating water-based foam.

BACKGROUND OF THE INVENTION

The use of foam as a camouflage within the visible range of wavelengths as well as within the infrared range and microwave range is previously known from European patent application No. 80 850057.3.

SUMMARY OF THE INVENTION

It is an object of the present invention to provide a new and improved system for camouflage with foam.

It is another object of the subject invention to provide a new and improved plant for generating water-based foam in large volumes to be applied directly to the ground or to filling containers, such as bags, to be placed on a vehicle or other suitable structure for camouflage purposes.

It is a further object of the subject invention to provide a camouflage system capable of being transported by a vehicle. The system is preferably installed in a container-like unit for transport on heavy vehicles when adapted for generating large volumes of foam to be applied to the ground. Alternative embodiments include a fixed or detachable installation to be placed on a vehicle or other suitable structure for filling camouflage bags.

These and other objects of the invention are achieved with a system according to Claim No. 1.

In the preferred embodiment of the invention, color reservoirs are connected to a foaming liquid in order to deliver coloring agents to said liquid, so that a foam is obtained that is colored in the desired way. This system may advantageously be adapted to include reservoirs for further additives such as anti-corrosion agents, stabilizing agents for prolonging the time of duration of the foam, and anti-freezing agents.

In a system for generating large volumes of foam, the foam generator is formed with a housing. A nozzle in the shape of a substantially rectangular frame is arranged at one end of the housing. Liquid is ejected through the housing, through this nozzle. A fan is arranged at the nozzle end of the housing for blowing air through the housing, so that air passes through the housing together with the foaming liquid, and further through a net arranged at the other end of the housing to form av light foam.

In a further developed embodiment of the system according to the present invention, the fan and the water pump are hydraulically driven. The pumps for other additives to the foaming liquid are powered by electricity. The rotational speed of all pumps is controllable, so that the composition of the foaming liquid and the foaming coefficient, the ratio between foaming liquid and air per volume unit, can be controlled. In the present invention the foaming coefficient is below 1000 and normally in the range of 100–150. The water pump can preferably be arranged to fill the water tank.

The system according to the present invention further preferably includes an internal combustion engine serving as a power source for the hydraulic pump and an electric generator to make the system form a self-supporting unit.

The system according to the invention preferably comprises camouflage bags, which after filling with foam, are placed on a vehicle for camouflage thereof. In this case, the bags are positioned on the vehicle so that this method can be used in the intended way without the camouflage interfering with or destroying the vehicle.

According to another embodiment of the invention, the system is installed on the vehicle to be camouflaged, and the bags are attached to and carried by the foam generators. In this case the bags are placed on the foam generators before being filled with foam. This allows the bags to be filled automatically from inside the vehicle obviating the need for a soldier to stay outside the vehicle. The foam bags are then preferably colored to form a visual camouflage. The thickness of the bags is adapted to attenuate infrared radiation and microwave radiation to a desired degree.

For applying foam to the ground, the system is preferably constructed with automatic coloring control means enabling a continous adjustment of the color of the foam to that of the surroundings. Such color control means includes photometers, preferably sensitive to white, red and blue colors, which by a moving mirror sense the color of the foam placed on the ground and the color of the surroundings. The signals from the photometers are fed to a computer, which in response to the comparison of these colors, controls the supply of different coloring agents, such as yellow, red, blue and black, foaming agents, and the supply of water, so that the color of the foam is adjusted to coincide with that of the surroundings in the best possible way. With this system, large volumes of foam can be generated in a simple way to be applied to the ground.

The foam applicator can be provided with heat insulation and heating devices. A spraying gun for heavy foam intended for fire-fighting purposes can also be provided. A control panel for the foam applicator can be placed in the foam applicator or in the transport vehicle.

Further objects and advantages of the subject invention will become apparent from the following detailed description when taken in conjunction with the drawings.

BRIEF DESCRIPTION OF THE DRAWINGS

FIG. 1 schematically illustrates the construction of the embodiment of a system according to the invention.

FIG. 2*a* shows a longitudinal sectional view of the embodiment of a foam generator in the system according to the invention.

FIG. 2*b* shows an end view of an embodiment of a foam generator in the system according to the invention.

DETAILED DESCRIPTION OF THE PREFERRED EMBODIMENTS

Figure 3:
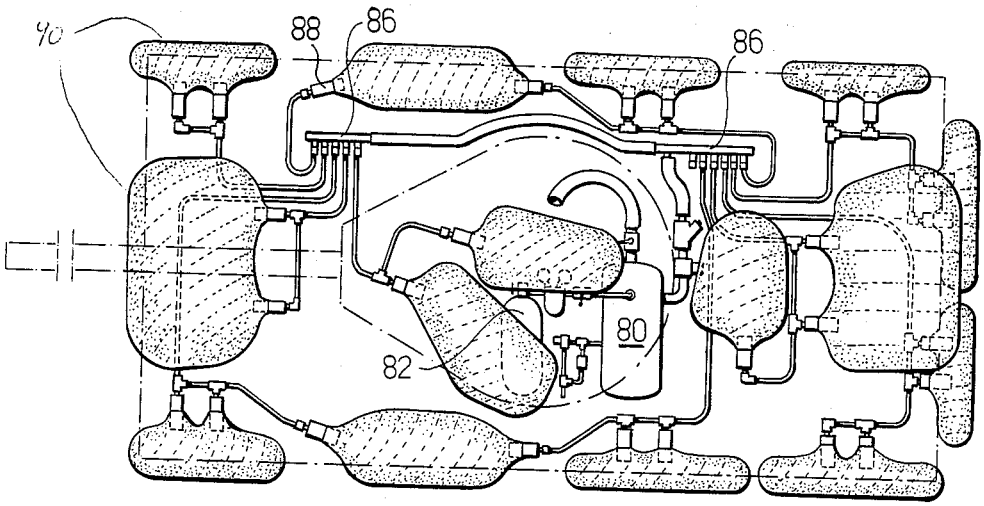
FIG. 3 illustrates a tank, seen from the top, on which a system according to the invention with filled foam bags is placed.

FIG. 1 illustrates a system intended for generating and applying large volumes of foam according to the present invention. The system includes a water tank 2 as well as five additional reservoirs 4,6,8,10,12, which respectively contain a stabilizer for prolonging the time for duration of the foam, a foaming agent, e.g. in the form of a surfactant, a first coloring agent, a second coloring agent and a third coloring agent. The coloring agents consist of water-soluble colors which rapidly disappear in the landscape when the foam is dissolved.

Each of the reservoirs 4,6,8,10, and 12 is connected via a pump 14,16,18,20, and 22 respectively to an output conduit 24 from the water tank 2. Each of the pumps 14,16,18,20,22 is driven by an electric motor 26,28,30,32, and 34 respectively, whereby, in a simple way, an individual control of the rotational speed of the pumps is made possible. By variation of the rotational speed of the electric motors 26,28,30,32,34 and with that the speed of the pumps 14,16,18,20,22, the amount of the different additives consisting of stabilizer, foaming agent and various coloring additives, may be controlled.

A water pump 36 is arranged on the conduit 24. The water pump 36 is driven by a hydraulic motor 38 and its rotational speed can be controlled in order to adjust the delivered volume.

By the pump 36 the foaming liquid can be pumped through a conduit 40 to a foam generator 42 for generating an intermediate foam having a foaming coefficient in the range of 30–200 and at a pressure of typically 5 bars. The foam generator is of a type to be described in detail in relation to FIG. 2 and can be used for filling foam bags in the system described in more detail in connection with FIGS. 3–5.

Alternatively, the cut-off valve 44 can be closed and the foaming liquid pumped to the foam generator 46. This foam generator 46 is constructed to produce large volumes of light foam with a foaming coefficient exceeding 200 and a liquid pressure of typically 1.5 bars. This foam is intended for application to the ground.

The foam generator 46 includes a rectangular housing 48, at the input end of which a nozzle 50 substantially in the shape of a rectangular frame is arranged, this nozzle 50 being fed with foaming liquid by the conduit 52. From the nozzle 50 the foaming liquid is sprayed through the space inside the housing 48 and out through a net 54, arranged at the opposite side of the housing 48, together with air, which a fan 56, arranged at the input side of the housing 48, blows through the output net 54 to obtain a light foam. As shown in FIG. 1 the net is pleated to increase the output area.

The water pump 36 and the fan 56 are each driven by a hydraulic motor 38 and 58 respectively. The pumps 14,16,18,20,22 for the different additives are each driven by an electro motor 26,28,30,32, and 34 respectively. A hydraulic pump 60 for the hydraulic motors and an electric generator 62 for the electric motors, are driven by an internal combustion engine 64, whereby the foam applying system forms a self-supporting unit as far as power is concerned. The whole system is preferably built into a container-like modular unit, which can easily be loaded on a suitable transport vehicle such as a heavy truck.

The water tank 2 is also provided with a connection 66 for filling water, e.g. from a vehicle for transport of liquid goods or by means of a pump from another water source. The water pump 36 itself can be used for filling of water.

The speed controlled hydraulic and electric motors allow the amount of the different additives to the foam liquid to be controlled, whereby the foaming coefficient, the foam capacity and the color of the foam can be regulated within wide limits.

The control panel for the foam applying system can either be placed in the modular container unit itself or in the transport vehicle.

The system can also be provided with a spraying gun for heavy foam intended for fire-fighting purposes.

FIGS. 2*a* and 2*b* illustrate a foam generator of the type used at 42 in the system according to FIG. 1 in a longitudinal sectional view and in an end view from the input side. At the input end the foam generator 42 is provided with a nipple 68 for the hose 40. Thus, foaming liquid is injected through the nipple 68 into the space inside the conical pipe 70, air being sucked together with the liquid through the space around the mouth of the nipple 68 and the pipe flange 72, as is schematically illustrated in FIG. 2*a*. At the end of the conical pipe 70 there is a conically shaped net 74, through which foaming liquid and air are thus exhausted for the formation of foam. The net 74 is surrounded by a protective cylindrical pipe 76. The nipple 68 is attached to the pipe flange 72 by means of a suitable number of arms 78, arranged circumferentially. Three arms 78 are evenly distributed circumferentially at a mutual distance of 120°.

The foam generator 42 in the system according to FIG. 1 can be used for filling camouflage bags which are then placed on a combat vehicle to be camouflaged.

FIG. 3 illustrates a second embodiment of the system according to the present invention, which is fixed or detachably mounted on a tank. This embodiment includes a foaming liquid reservoir 80 containing a mixture of foaming agent and water. The reservoir 80 is pressurized from a compressed air bottle 82. From the foaming liquid reservoir a conduit 84 passes to distributing pipes 86 with cut-off valves. Conduits pass from these distributor pipes 86 to twenty-seven foam generators 88 located in the desired way on the tank. These foam generators can be of the type shown in FIG. 2. Fifteen foam bags 90 are connected to these foam generators 88. When the valves belonging to the respective foam generators 88 are opened, the pressurized foaming liquid is pressed together with coejected air through the foam generator to obtain foam, which is used for filling the bags 90 under pressure.

In this way the camouflage can be rapidly applied to the vehicle and it can be driven and used in other ways with the camouflage applied to it.

The foaming liquid container 80, the compressed air bottle 82 and the associated valves and filters are suitably placed within the tank, and the system is controlled from inside the vehicle.

Figure 4:
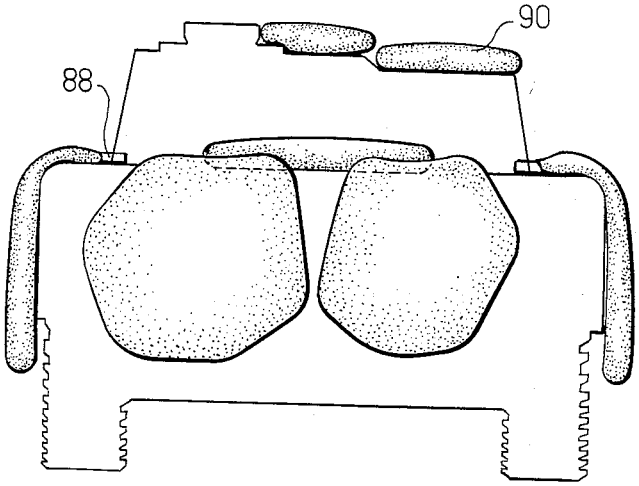
FIG. 4 illustrates schematically a tank, seen from behind, provided with foam-filled camouflage bags.

The camouflage bags 90 are preferably of such a color that a good visible camouflage is obtained when they are moist, and their form and position are chosen to obtain good camouflage for microwaves as well as infrared and visual radiation. For this, the shape of the bags is adapted to the actual position, as shown in FIGS. 3 and 4.

The bags 90 must be of sufficient thickness to obtain a satisfactory attenuation of infrared waves and microwaves. The camouflage bags 90 are conveniently manufactured from cotton. The outer cloth therein is moistened by the foam in the bags and this cloth is permeable to air but not to foam.

Figure 5:
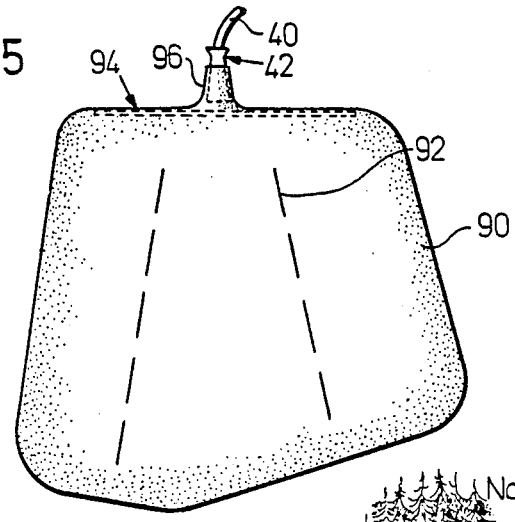
FIG. 5 illustrates a foam bag in the system according to FIGS. 3 and 4, mounted on a foam generator of the type shown in FIGS. 2*a* and 2*b*.

FIG. 5 illustrates a foam bag 90. The bag contains partitions 92 in order to give the filled bag a relatively flat shape, as shown in FIGS. 3 and 4 or any other shape adapted to the actual position on the vehicle. Instead of partitions, threads arranged appropriately and connecting the walls of the bag in the interior, can be used for this purpose. The upper end of the bag includes a guiding bar 94 and the bag is mounted with its mouth 96 on a foam generator 42. The bags 90 have a small weight in comparison with their area. The area is typically about 1.5 $m^2$ and the thickness of the bag about 0.15 m.

Figure 6:
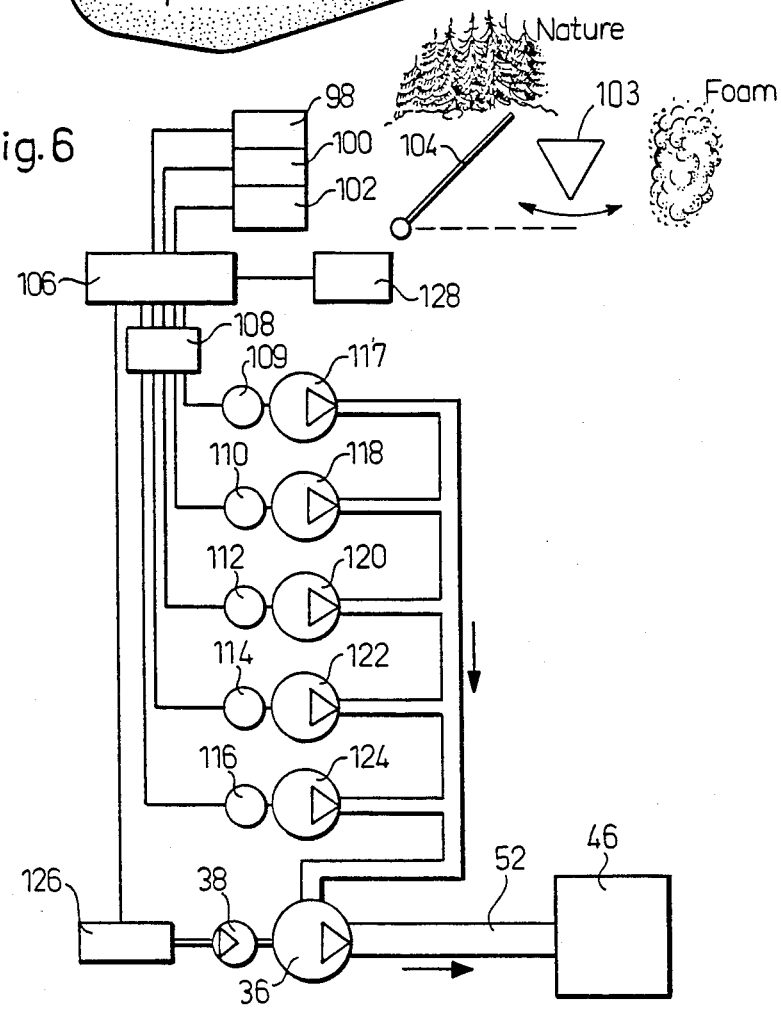
FIG. 6 diagrammatically illustrates the construction of automatic control means of the system according to the invention for continuous adjustment of the color of the foam to that of the surroundings.

FIG. 6 illustrates an automatic color control device in the system according to FIG. 1 for automatic adjustment of the color of the foam to that of the surroundings when applying foam to the ground. The foam should be colored to resemble the surroundings, as this will give the best camouflage effect to the covered ground area.

The color control device illustrated in FIG. 6 consists of a color measuring unit, a control unit and a foam coloring unit. The color measuring unit includes three photometers 98,100,102, suitably sensitive to white, blue and red colors respectively, which by a moving mirror 104 measure color and light alternatively of applied foam and of the surroundings. Instead of the moving mirror 104 a moving 103 prism can be used.

The measured values from the photometers 98,100,102 are fed to the control unit of the device, a computer 106, which by a digital-to-analog converter 108 controls the electric motors 109,110,112,114,116 driving the pumps 117,118,120,122,124 for the delivery of coloring agents, suitably yellow, blue, red and black colors, and foaming agent. The electric motors 109,110,112,114,116 and the pumps 117,118,120,122,124 correspond to the motors 28,30,32,34 and the pumps 16,18,20,22 of the embodiment illustrated in FIG. 1, however the embodiment according to FIG. 6 is constructed for four coloring agents besides the foaming agent while the system according to FIG. 1 is constructed for three coloring agents.

In response to the measured values from the photometers 98,100,102 the computer 106, by a hydraulic valve 126, also controls the hydraulic motor 38 driving the water pump 36, so that the foam generator 46 via the conduit 52 is fed with a foaming agent which produces a foam, the color of which, as well as possible, coincides with that of the surroundings. The rotational speed of the driving motors are thus controlled by the computer unit in response to comparative color measurements on the foam and on the surroundings.

The computer 106 can also be constructed for manual control by the unit 128, so that the color of the foam is adjusted to that of the surroundings manually by an operator observing the foam and the color of the surroundings. The unit 128 comprises a set of buttons each button corresponding to a certain color of the foam. The set can consist of several buttons which are maneuvered by an operator observing the foam and color of the surroundings. When the operator presses a certain button, a corresponding signal is delivered to the computer which responds by controlling the electric motors 109, 110, 112, 114, 116 driving the pumps 117, 118, 120, 122, 124 for delivery of coloring agents so that the produced foam will have a color corresponding to the button pressed by the operator.

The color control device described above can also be used for other purposes and can be constructed as a control system for the continuos adjustment of paints of predetermined color, e.g. when dyeing fabric material.

It should be understood that while the subject invention has been disclosed with reference to a preferred embodiment, various alternatives to the system herein may be employed in practicing the present invention. It is intended that the following claims define the invention, and that the system within the scope of these claims and their equivalents be covered thereby.

We claim:

1. A vehicle carried system for camouflage with foam comprising:

a foam generating plant;

a foaming agent and water;

foam generators, and pumps associated with said foam generators;

containers formed of bags, preferably of cotton, colored to give a visual camouflage when moist and containing threads connected to the walls of said bags for modifying shape of said bags; wherein said containers are attached to and carried by said foam generators, said containers having a shape which can be adapted by the adjustment of said threads in said bags to a particular position on a vehicle, said containers being filled with said foam by said pumps from said generators thereby moistening said bags to produce said visual camouflage.

2. A system for automatically applying a colored foam to ground comprising:

color control means including photometers to generate signals and a computer;

a movable prism or movable mirror;

a foam generating plant for generating colored foam from a foam agent having a color and water;

a plurality of reservoirs, each reservoir containing different foam coloring agents;

a plurality of pumps, each of which is associated with said reservoirs, wherein said mirror or prism directs the ambient light and colors of surrounding areas toward said photometers, said photometers thereby generating signals related to colors of said surrounding areas which signals are fed to said computers, said computer thereafter comparing said signals to said color of said foaming agent and controlling said pumps to add said coloring agents to said foaming agent so that said colored foam coincides with said ambient light and colors of said surrounding areas; said surrounding areas including the ground and any foam generated from said foam generators.

3. A system according to claim 2, wherein said color control means includes photometers for sensing white, blue and red colors.

4. A system according to claim 2 or 3, wherein said computer controls pumps of separate reservoirs for yellow, blue, red and black coloring agents of said foam generating plant.

5. A system according to claim 4, wherein said pumps are driven by electric motors controlled by the computer.

* * * * *